US009373284B2

(12) United States Patent
Zhang

(10) Patent No.: US 9,373,284 B2
(45) Date of Patent: Jun. 21, 2016

(54) LED BACKLIGHT DRIVING CIRCUIT, LCD DEVICE, AND METHOD FOR DRIVING THE LED BACKLIGHT DRIVING CIRCUIT

(71) Applicant: SHENZHEN CHINA STAR OPTOELECTRONICS TECHNOLOGY CO., LTD, Shenzhen (CN)

(72) Inventor: Hua Zhang, Shenzhen (CN)

( * ) Notice: Subject to any disclaimer, the term of this patent is extended or adjusted under 35 U.S.C. 154(b) by 413 days.

(21) Appl. No.: 13/985,575

(22) PCT Filed: Jul. 5, 2013

(86) PCT No.: PCT/CN2013/078912
§ 371 (c)(1),
(2) Date: Aug. 15, 2013

(87) PCT Pub. No.: WO2015/000179
PCT Pub. Date: Jan. 8, 2015

(65) Prior Publication Data

US 2015/0008839 A1 Jan. 8, 2015

(30) Foreign Application Priority Data

Jul. 2, 2013 (CN) ..... 2013 1 0274509

(51) Int. Cl.
*H05B 33/08* (2006.01)
*G09G 3/34* (2006.01)

(52) U.S. Cl.
CPC ..... *G09G 3/3406* (2013.01); *H05B 33/0815* (2013.01); *H05B 33/0827* (2013.01); *H05B 33/0845* (2013.01)

(58) Field of Classification Search
USPC ..... 315/210
See application file for complete search history.

(56) References Cited

U.S. PATENT DOCUMENTS

2011/0204800 A1 8/2011 Fox
2013/0154484 A1* 6/2013 Xu ..... H05B 33/0827 315/122

FOREIGN PATENT DOCUMENTS

| | | | |
|---|---|---|---|
| CN | 101169918 | A | 4/2008 |
| CN | 101711071 | A | 5/2010 |
| CN | 202013725 | U | 10/2011 |
| CN | 102646396 | A | 8/2012 |
| CN | 102682721 | A | 9/2012 |
| CN | 102769959 | A | 11/2012 |
| CN | 103107697 | A | 5/2013 |

OTHER PUBLICATIONS

Wang Chao, the International Searching Authority written comments, May 2014, CN.

* cited by examiner

*Primary Examiner* — Douglas W Owens
*Assistant Examiner* — Srinivas Sathiraju

(57) ABSTRACT

A light emitting diode (LED) backlight driving circuit includes a power supply, an LED lightbar coupled to the power supply, and a constant current driving chip coupled to a control end of the power supply and coupled to a cathode of the LED lightbar. The constant current driving chip includes an adjusting dimming unit coupled to the cathode of the LED lightbar, and the adjusting dimming unit adjusts an external pulse-width modulation (PWM) dimming signal. A controllable switch unit is connected in series between an output end of the power supply and the constant current driving chip, and logical operation of the controllable switch unit is relative to logical operation of the adjusting dimming unit. The controllable switch unit turns off when the adjusting dimming unit turns off or before the adjusting dimming unit turns off, and the controllable switch unit turns on when the adjusting dimming unit turns on or after the adjusting dimming unit turns on.

14 Claims, 5 Drawing Sheets

LED BACKLIGHT DRIVING CIRCUIT, LCD DEVICE, AND METHOD FOR DRIVING THE LED BACKLIGHT DRIVING CIRCUIT

TECHNICAL FIELD

The present disclosure relates to the field of liquid crystal displays (LCDs), and more particularly to a light emitting diode (LED) backlight driving circuit, an LCD device, and a method for driving the LED backlight driving circuit.

BACKGROUND

As shown in FIG. 1, a light emitting diode (LED) backlight driving circuit of a liquid crystal display (LCD) device includes a power supply 10, and an LED lightbar 20 coupled to the power supply 10. A constant current driving chip 30 is used to control brightness of the LED lightbar 20, and an external pulse-width modulation (PWM) dimming signal is sent to the constant current driving chip 30. When the PWM dimming signal is at a high level, current flows through the LED lightbar 20, and when the PWM dimming signal is at a low level, current does not flow through the LED lightbar 20. An average value of the current flowing through the LED lightbar 20 is controlled by adjusting a duty cycle of the PWM dimming signal, thus the brightness of the LED lightbar 20 may be adjusted. A typical PWM dimming method may damage the constant current driving chip 30.

SUMMARY

As shown in FIG. 1, a light emitting diode (LED) backlight driving circuit of a liquid crystal display (LCD) device includes a power supply 10, and an LED lightbar 20 coupled to the power supply 10. A constant current driving chip 30 is used to control brightness of the LED lightbar 20, and an external pulse-width modulation (PWM) dimming signal is sent to the constant current driving chip 30. When the PWM dimming signal is at a high level, current flows through the LED lightbar 20, and when the PWM dimming signal is at a low level, current does not flow through the LED lightbar 20. An average value of the current flowing through the LED lightbar 20 is controlled by adjusting a duty cycle of the PWM dimming signal, thus the brightness of the LED lightbar 20 may be adjusted. A typical PWM dimming method may damage the constant current driving chip 30.

DETAILED DESCRIPTION

Figure 1:
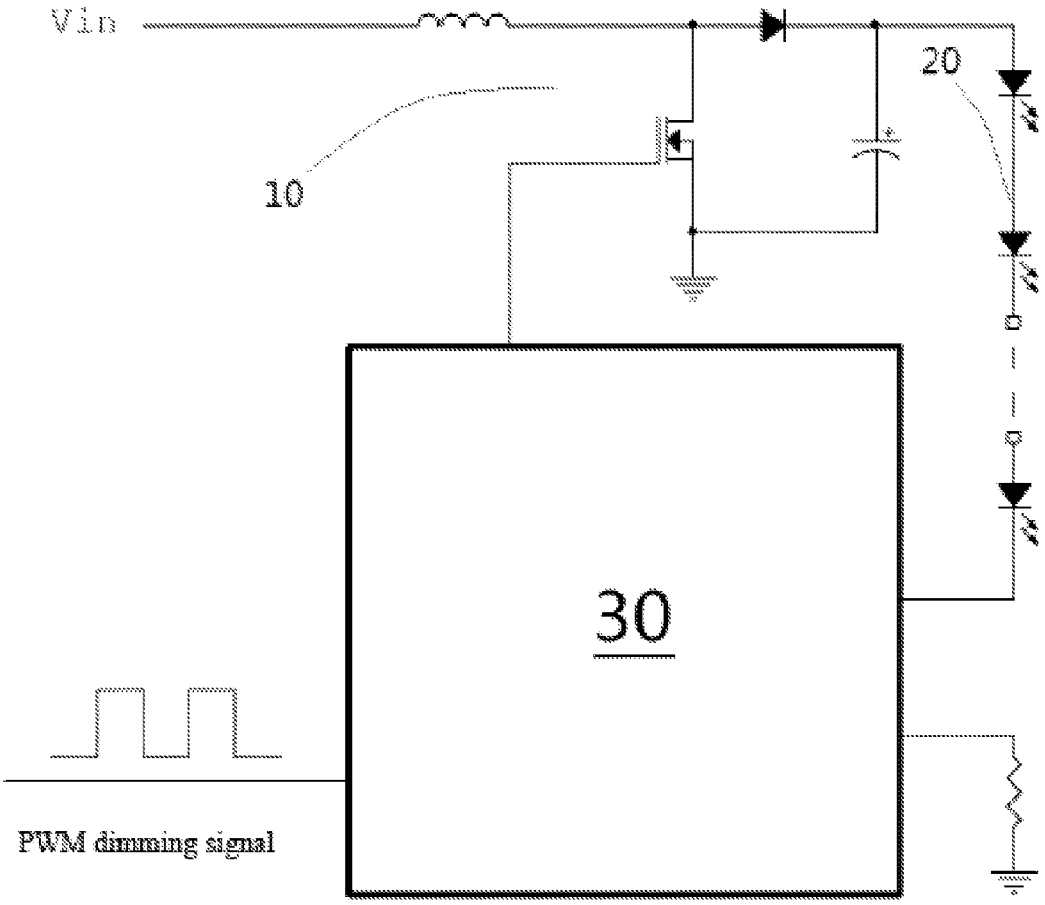
FIG. 1 (PRIOR ART)
FIG. 1 is a schematic diagram of a typical light emitting diode (LED) backlight driving circuit.
Figure 2:
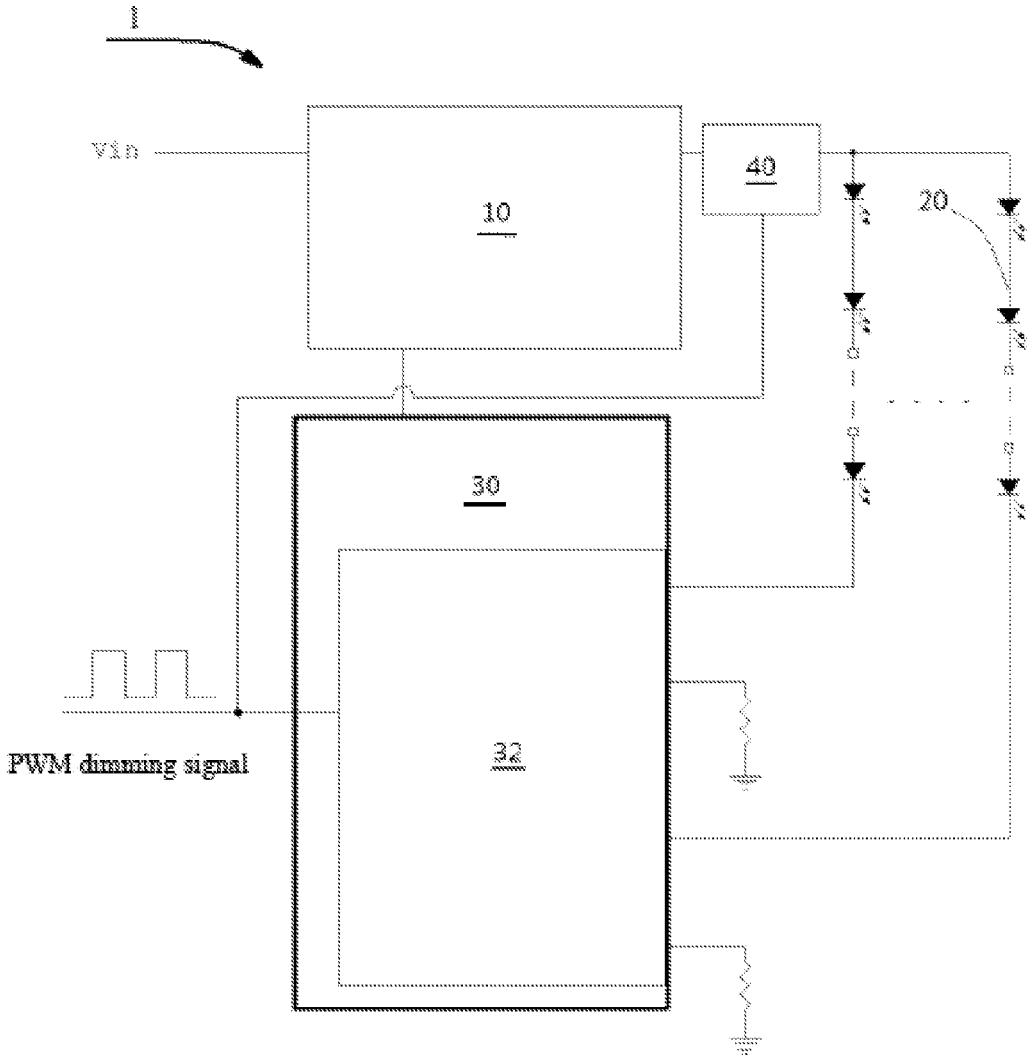
FIG. 2 is a schematic diagram of a light emitting diode (LED) backlight driving circuit of the present disclosure.

The present disclosure provides a liquid crystal display (LCD) device comprising a light emitting diode (LED) backlight driving circuit 1. As shown in FIG. 2, the LED backlight driving circuit 1 comprises a power supply 10, an LED lightbar 20 coupled to the power supply 10, and a constant current driving chip 30 coupled to a control end of the power supply 10 and coupled to a cathode of the LED lightbar 20. The constant current driving chip 30 comprises an adjusting dimming unit 32 coupled to the cathode of the LED lightbar 20, and the adjusting dimming unit 32 adjusts an external pulse-width modulation (PWM) dimming signal. The LED lightbar 20 is connected in series with a controllable switch unit 40, and logical operation of the controllable switch unit 40 is relative to logical operation of the adjusting dimming unit 32. The controllable switch unit 40 turns off when the adjusting dimming unit 32 turns off or before the adjusting dimming unit 32 turns off. The controllable switch unit 40 turns on when the adjusting dimming unit 32 turns on or after the adjusting dimming unit 32 turns on.

The external pulse-width modulation (PWM) dimming signal may be used to control the controllable switch unit 40 and the adjusting dimming unit 32 to synchronously turn on/off. It also should be considered that the controllable switch unit 40 and the adjusting dimming unit 32 are separately controlled.

When the PWM dimming signal is at a low level (logic 0), current does not flow through the LED lightbar 20, thus a voltage drop of the LED lightbar 20 decreases. But the power supply 10 continually outputs a large voltage, so a voltage of the cathode of the LED lightbar 20 is correspondingly great, which damages the constant current driving chip 30. In the present disclosure, the controllable switch unit 40 is connected in series between an output end of the power supply 10 and the constant current driving chip 30, and the logical operation of the controllable switch unit 40 is relative to the logical operation of the adjusting dimming unit 32, where the controllable switch unit 40 turns off when the adjusting dimming unit 32 turns off or before the adjusting dimming unit 32 turns off. Thus, the controllable switch unit 40 turns off before the adjusting dimming unit 32 turns off, and the LED lightbar 20 cannot receive the large voltage output by the power supply 40, the voltage of the cathode of the LED lightbars 20 is correspondingly low, therefore, the constant current driving chip 30 does not receive the large voltage, which avoids the constant current driving chip 30 from being damaged by the large voltage, and improves reliability and working life of the LED backlight driving circuit.

The present disclosure is further described in detail in accordance with the figures and the exemplary examples.

EXAMPLE 1

Figure 3:
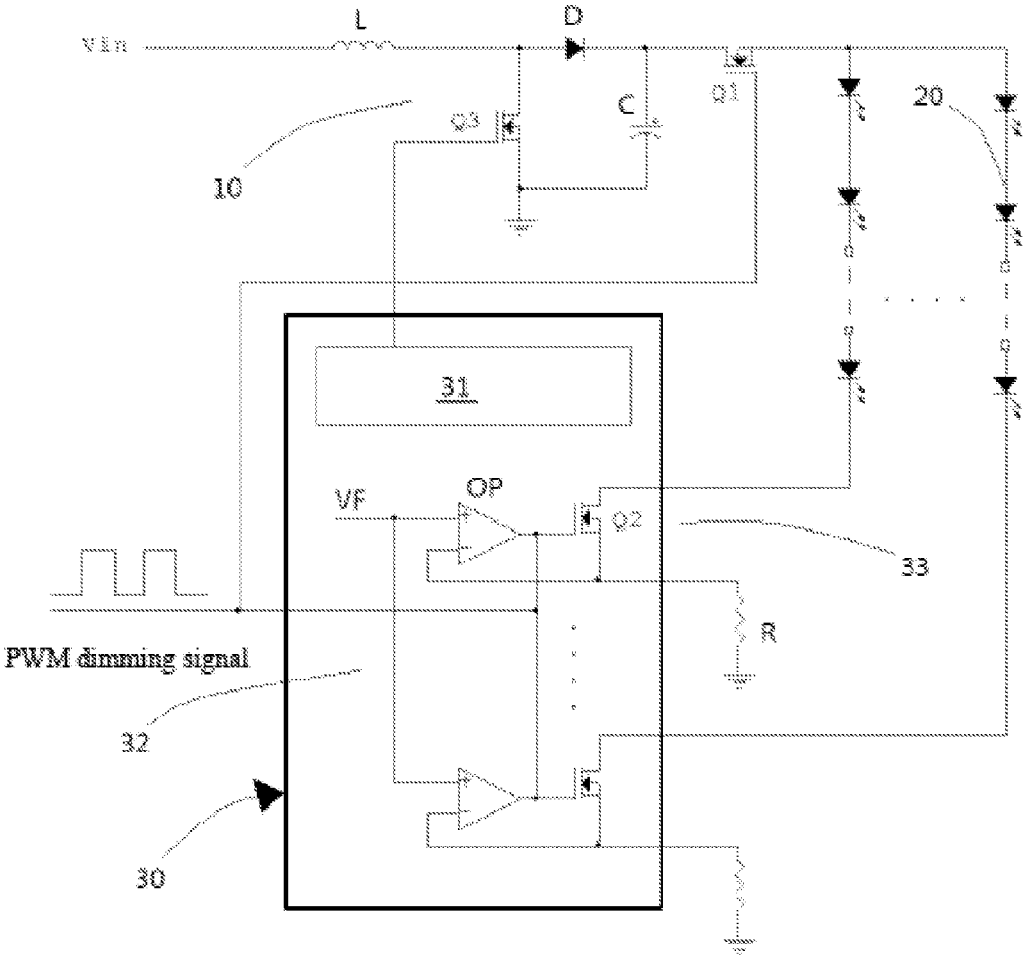
FIG. 3 is a schematic diagram of a light emitting diode (LED) backlight driving circuit of a first example of the present disclosure.

As shown in FIG. 3, a backlight driving circuit 1 of a first example comprises a power supply 10, an LED lightbar 20 coupled to the power supply 10, and a constant current driving chip 30 coupled to a control end of the power supply 10 and coupled to a cathode of the LED lightbar 20. The constant current driving chip 30 comprises an adjusting dimming unit 32 coupled to the cathode of the LED lightbar 20, and the adjusting dimming unit 32 adjusts a PWM dimming signal. The LED lightbar 20 is connected in series with a controllable switch unit 40, and logical operation of the controllable switch unit 40 is relative to logical operation of the adjusting dimming unit 32.

The controllable switch unit 40 comprises a first metal-oxide-semiconductor field-effect transistor (MOSFET) Q1. A number of the LED lightbar 20 is at least two, and each of the LED lightbars 20 is connected with each other in parallel. An anode of each of the LED lightbars 20 is coupled to the power supply 10. The adjusting dimming unit 32 comprises dimming channels 33. The dimming channels 33 are corresponding to the cathodes of the LED lightbars 20 one by one. A number of the first MOSFET Q1 is one, and the first MOSFET Q1 is connected in series between the power supply 10 and the anode of the LED lightbars 20. A same external PWM dimming signal is sent to the controllable switch unit 40 and the adjusting dimming unit 32 to control the controllable switch unit 40 and the adjusting dimming unit 32 to synchronously turn on/off, which simplifies control method, shortens development time, and lowers production cost. It should be considered that the controllable switch unit 40 and the adjusting dimming unit 32 may be separately controlled. Regardless of using any one of the two control methods, the first MOSFET Q1 turns off before the adjusting dimming unit 32 turns off or when the adjusting dimming unit 32 turns off, and the first MOSFET Q1 turns on when the adjusting dimming unit 32 turns on or after the adjusting dimming unit 32 turns on.

The LED backlight driving circuit 1 comprises a resistor R. Each of the dimming channels 33 of the adjusting dimming unit 32 comprises a comparator OP and a second MOSFET Q2. The LED lightbars 20 are connected with a ground terminal of the LED backlight driving circuit 1 through the second MOSFET Q2 and the resistor R. The external PWM dimming signal is sent to a control end of the second MOSFET Q2, and the control end of the second MOSFET Q2 is coupled to an output end of the comparator OP. A reference voltage VF is input to a non-inverting end of the comparator OP, and an inverting end of the comparator OP is coupled to an end of the second MOSFET Q2 that is adjacent to the resistor R.

The power supply 10 comprises an inductor L, a diode D, a third MOSFET Q3, and a capacitor C. A first end of the inductor L is coupled to an input end of the power supply 10, a second end of the inductor L is coupled to an anode of the diode D, and the second end of the inductor L is coupled to the ground terminal of the LED backlight driving circuit 1 through the third MOSFET Q3. A cathode of the diode D is coupled to an anode of the LED lightbars 20, and the cathode of the diode D is coupled to the ground terminal of the LED backlight driving circuit 1 through the capacitor C. The constant current driving chip 30 further comprises a control unit 31 coupled to a control end of the third MOSFET Q3.

The first example provides a circuit structure of a plurality of LED lightbars connected with each other in parallel and the controllable switch unit comprising the MOSFET. Because the plurality of LED lightbars is connected with each other in parallel, all LED lightbars are controlled to turn on/off by only one controllable switch unit, which lowers cost.

EXAMPLE 2

Figure 4:
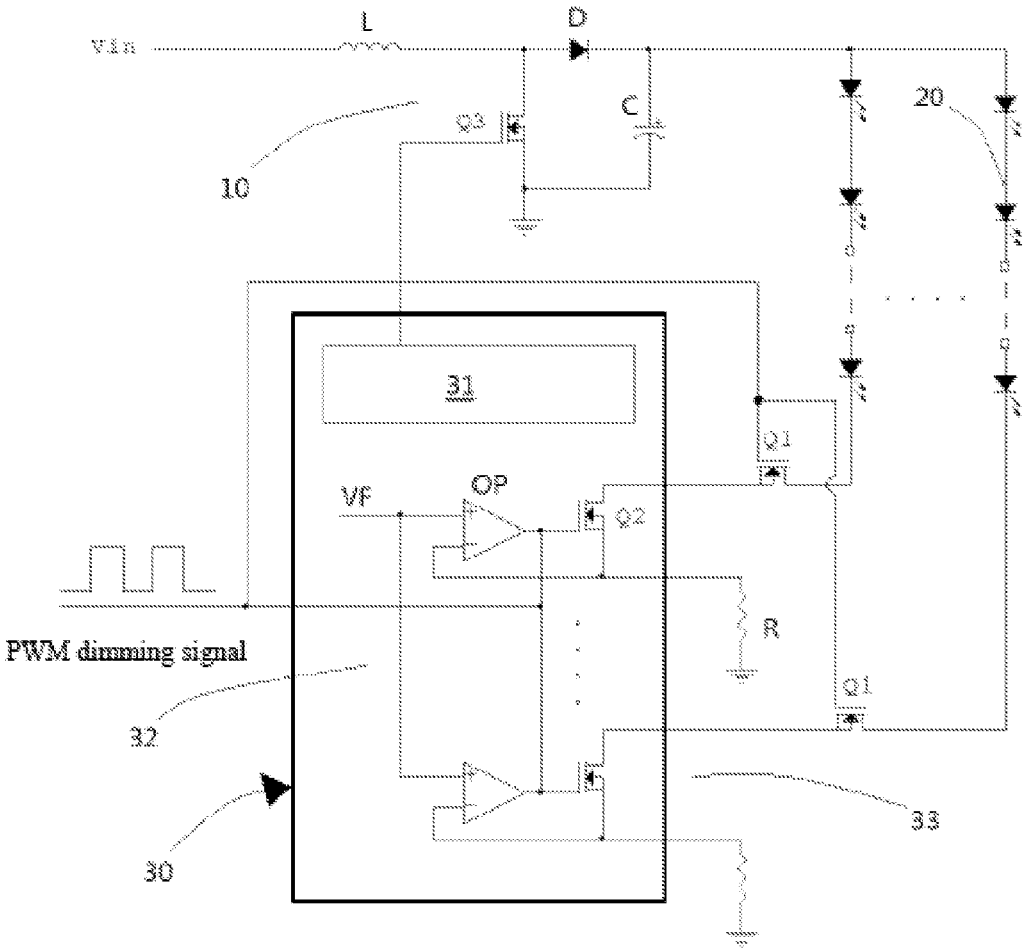
FIG. 4 is a schematic diagram of a light emitting diode (LED) backlight driving circuit of a second example of the present disclosure.

The first MOSFET Q1 is connected in series with the anode of the LED lightbars, and it should be considered that the first MOSFET Q1 is also connected in series with the cathode of the LED lightbars. As shown in FIG. 4, a number of the first MOSFET Q1 is same as a number of the LED lightbars, and each of the LED lightbars 20 is correspondingly coupled to one dimming channel 33 through one first MOSFET Q1. Each of the LED lightbars 20 is independently connected in series with one controllable switch unit, thus, each of the controllable switch units only loads one LED lightbar 20, which decreases power loss of each of the controllable switch units and improves working life of the controllable switch units.

EXAMPLE 3

Figure 5:
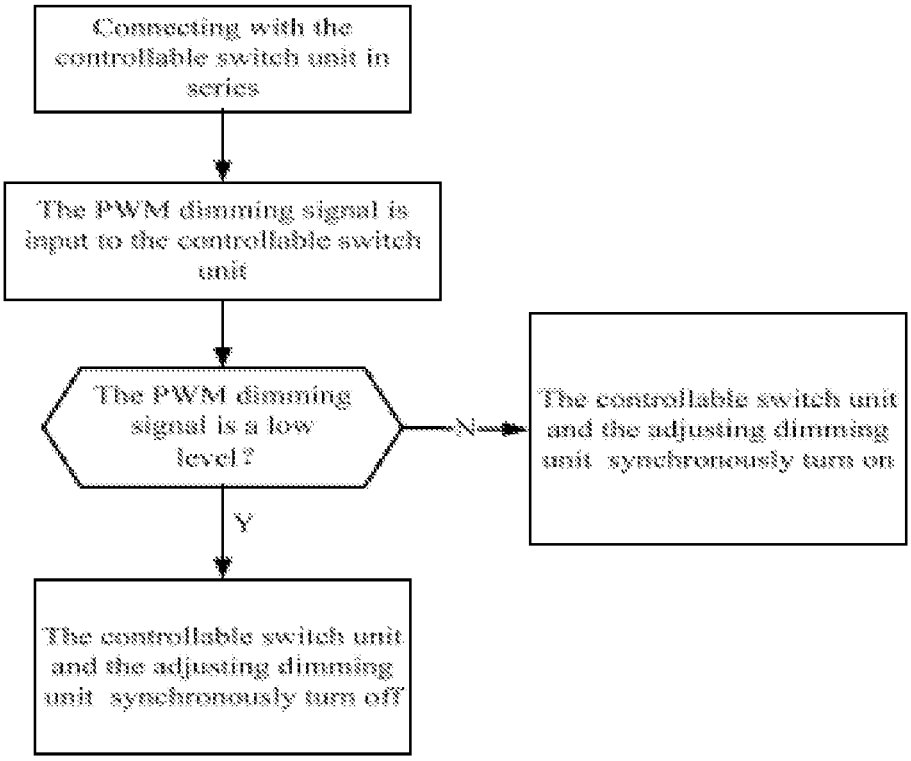
FIG. 5 is a flowchart of a method for driving a light emitting diode (LED) backlight driving circuit of a third example of the present disclosure.

As shown in FIG. 5, the present disclosure provides a method for driving an LED backlight driving circuit 1, the backlight driving circuit comprises an LED lightbar 20, and an adjusting dimming unit 32 connected in series with a cathode of the LED lightbar 20. The adjusting dimming unit 32 adjusts a PWM dimming signal. And the method comprises:

A: connecting a controllable switch unit 40 with the cathode or an anode of the LED lightbar 20; and B: turning off the controllable switch unit 40 when the adjusting dimming unit 32 turns off or before the adjusting dimming unit 32 turns off, and turning on the controllable switch unit 40 when the adjusting dimming unit 32 turns on or after the adjusting dimming unit 32 turns on.

Specifically, in the step B, a same external PWM dimming signal is sent to the controllable switch unit 40 and the adjusting dimming unit 32. When the PWM dimming signal is at a low level, the controllable switch unit 40 and the adjusting dimming unit 32 synchronously turn off. When the PWM dimming signal is at a high level (logic 1), the controllable switch unit 40 and the adjusting dimming unit 32 synchronously turn on. Thus, synchronous operation of the controllable switch unit 40 and the adjusting dimming unit 32 is obtained, which simplifies control method, shortens development time, and lowers production cost. It should be considered that the controllable switch unit 40 and the adjusting dimming unit 32 are also separately controlled.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. A light emitting diode (LED) backlight driving circuit, comprising:

a power supply;

an LED lightbar coupled to the power supply; and a constant current driving chip coupled to a control end of the power supply and coupled to a cathode of the LED lightbar;

wherein the constant current driving chip comprises an adjusting dimming unit coupled to the cathode of the LED lightbar, and the adjusting dimming unit adjusts an external pulse-width modulation (PWM) dimming signal; a controllable switch unit is connected in series between an output end of the power supply and the constant current driving chip, and logical operation of the controllable switch unit is relative to logical operation of the adjusting dimming unit;

the controllable switch unit turns off when the adjusting dimming unit turns off or before the adjusting dimming unit turns off, and the controllable switch unit turns on when the adjusting dimming unit turns on or after the adjusting dimming unit turns on, wherein the controllable switch unit comprises a first metal-oxide-semiconductor field-effect transistor (MOSFET); a number of the LED lightbars is at least two, and each of the LED lightbars is connected in parallel with each other; an anode of each of the LED lightbars is coupled to the power supply;

the adjusting dimming unit comprises dimming channels; the dimming channels are corresponding to the cathodes of the LED lightbars one by one; a number of the first MOSFET is one, and the first MOSFET is connected in series between the power supply and the anode of the LED lightbars; a same external PWM dimming signal is sent to the first MOSFET and the adjusting dimming unit, further comprising a resistor; wherein each of the dimming channels of the adjusting dimming unit comprises a comparator and a second MOSFET; the LED lightbars are connected with a ground terminal of the LED backlight driving circuit through the second MOSFET and the resistor; a control end of the second MOSFET is coupled to an output end of the comparator, and the external PWM dimming signal is sent to the control end of the second MOSFET; a reference voltage is input to a non-inverting end of the comparator, and an inverting end of the comparator is coupled to an end of the second MOSFET that is adjacent to the resistor.

2. The LED backlight driving circuit of claim 1, wherein a same external PWM dimming signal is sent to the controllable switch unit and the adjusting dimming unit.

3. The LED backlight driving circuit of claim 1, wherein a number of the LED lightbar is at least two, and each of the LED lightbars is connected in parallel with each other; an anode of each of the LED lightbars is coupled to the power supply;

the adjusting dimming unit comprises dimming channels, the dimming channels are corresponding to the cathodes of the LED lightbars one by one.

4. The LED backlight driving circuit of claim 3, wherein a same external PWM dimming signal is sent to the controllable switch unit and the adjusting dimming unit.

5. The LED backlight driving circuit of claim 3, wherein a number of the controllable switch unit is one, and the controllable switch unit is connected in series between the power supply and the anode of the LED lightbars.

6. The LED backlight driving circuit of claim 5, wherein a same external PWM dimming signal is sent to the controllable switch unit and the adjusting dimming unit.

7. The LED backlight driving circuit of claim 3, wherein a same external PWM dimming signal is sent to the controllable switch unit and the adjusting dimming unit.

8. The LED backlight driving circuit of Claim 1, wherein the power supply comprises an inductor, a diode, a third MOSFET, and a capacitor a first end of the inductor is coupled to an input end of the power supply, a second end of the inductor is coupled to an anode of the diode, and the second end of the inductor is coupled to the ground terminal of the LED backlight driving circuit through the third MOSFET a cathode of the diode is coupled to the anode of the LED lightbars, and the cathode of the diode is coupled to the ground terminal of the LED backlight driving circuit through the capacitor; the constant current driving chip further comprises a control unit coupled to a control end of the third MOSFET.

9. A method for driving a light emitting diode (LED) backlight driving circuit, the backlight driving circuit comprising an LED lightbar and an adjusting dimming unit connected in series with a cathode of the LED lightbar, wherein the controllable switch unit comprises a first metal-oxide-semiconductor field-effect transistor (MOSFET); a number of the LED lightbars is at least two, and each of the LED lightbars is connected in parallel with each other; an anode of each of the LED lightbars is coupled to the power supply;

the adjusting dimming unit comprises dimming channels; the dimming channels are corresponding to the cathodes of the LED lightbars one by one; a number of the first MOSFET is one, and the first MOSFET is connected in series between the power supply and the anode of the LED lightbars; a same external PWM dimming signal is sent to the first MOSFET and the adjusting dimming unit, further comprising a resistor; wherein each of the dimming channels of the adjusting dimming unit comprises a comparator and a second MOSFET; the LED lightbars are connected with a ground terminal of the LED backlight driving circuit through the second MOSFET and the resistor; a control end of the second MOSFET is coupled to an output end of the comparator, and the external PWM dimming signal is sent to the control end of the second MOSFET; a reference voltage is input to a non-inverting end of the comparator, and an inverting end of the comparator is coupled to an end of the second MOSFET that is adjacent to the resistor; the method comprising:

A: connecting a controllable switch unit with the cathode or an anode of the LED lightbar; and B: turning off the controllable switch unit when the adjusting dimming unit turns off or before the adjusting dimming unit turns off, and turning on the controllable switch unit when the adjusting dimming unit turns on or after the adjusting dimming unit turns on.

10. A light crystal display (LCD) device, comprising:

a light emitting diode (LED) backlight driving circuit;

wherein the LED backlight driving circuit comprises a power supply, an LED lightbar coupled to the power supply, and a constant current driving chip coupled to a control end of the power supply and coupled to a cathode of the LED lightbar;

the constant current driving chip comprises an adjusting dimming unit coupled to the cathode of the LED lightbar, and the adjusting dimming unit adjusts an external pulse-width modulation (PWM) dimming signal; a controllable switch unit is connected in series between an output end of the power supply and the constant current driving chip, and logical operation of the controllable switch unit is relative to logical operation of the adjusting dimming unit;

the controllable switch unit turns off when the adjusting dimming unit turns off or before the adjusting dimming unit turns off, and the controllable switch unit turns on when the adjusting dimming unit turns on or after the adjusting dimming unit turns on, wherein the controllable switch unit comprises a first metal-oxide-semiconductor field-effect transistor (MOSFET); a number of the LED lightbars is at least two, and each of the LED lightbars is connected in parallel with each other; an anode of each of the LED lightbars is coupled to the power supply;

the adjusting dimming unit comprises dimming channels; the dimming channels are corresponding to the cathodes of the LED lightbars one by one; a number of the first MOSFET is one, and the first MOSFET is connected in series between the power supply and the anode of the LED lightbars; a same external PWM dimming signal is sent to the first MOSFET and the adjusting dimming unit, wherein the LED backlight driving circuit comprises a resistor; wherein each of the dimming channels of the adjusting dimming unit comprises a comparator and a second MOSFET; the LED lightbars are connected with a ground terminal of the LED backlight driving circuit through the second MOSFET and the resistor; a control end of the second MOSFET is coupled to an output end of the comparator, and the external PWM dimming signal is sent to the control end of the second MOSFET; a reference voltage is input to a non-inverting end of the comparator, and an inverting end of the comparator is coupled to an end of the second MOSFET that is adjacent to the resistor.

11. The LCD device of claim 10, wherein a same external PWM dimming signal is sent to the controllable switch unit and the adjusting dimming unit.

12. The LCD device of claim 10, wherein a number of the LED lightbar is at least two, and each of the LED lightbars is connected in parallel with each other; an anode of each of the LED lightbars is coupled to the power supply, the adjusting dimming unit comprises dimming channels; the dimming channels are corresponding to the cathodes of the LED lightbars one by one.

13. The LCD device of claim 12, wherein a number of the controllable switch unit is one, and the controllable switch unit is connected in series between the power supply and the anode of the LED lightbars.

14. The LCD device of claim 10, wherein the power supply comprises an inductor, a diode, a third MOSFET, and a capacitor; a first end of the inductor is coupled to an input end of the power supply, a second end of the inductor is coupled to an anode of the diode, and the second end of the inductor is coupled to the ground terminal of the LED backlight driving circuit through the third MOSFET; a cathode of the diode is coupled to the anode of the LED lightbars, and the cathode of the diode is coupled to the ground terminal of the LED backlight driving circuit through the capacitor; the constant current driving chip further comprises a control unit coupled to a control end of the third MOSFET.

* * * * *